United States Patent [19]

Kupperman et al.

[11] 4,301,942

[45] Nov. 24, 1981

[54] INSULATED CONTAINER

[75] Inventors: Sam Kupperman, Chicago; Dennis Kupperman, Glenview, both of Ill.

[73] Assignee: RB Products Corporation, Skokie, Ill.

[21] Appl. No.: 59,487

[22] Filed: Jul. 20, 1979

Related U.S. Application Data

[63] Continuation of Ser. No. 905,639, May 15, 1978, abandoned.

[51] Int. Cl.[3] ..... A47G 19/22; B65D 8/06

[52] U.S. Cl. ..... 220/444; 215/13 R; 220/22; 220/90.4; 220/215; 220/338; 220/344; 220/369

[58] Field of Search ..... 220/22, 90.4, 22.1, 220/22.3, 469, 90.2, 344, 338, 215, 444; 215/12 A, 13 R, 6; 206/545

[56] References Cited

U.S. PATENT DOCUMENTS

| | | | |
|---|---|---|---|
| 166,102 | 7/1875 | Hennaman et al. | 220/22 |
| 584,937 | 6/1897 | Hilliary . | |
| 1,034,313 | 7/1912 | Shafer et al. . | |
| 1,518,906 | 12/1924 | Edwards | 137/576 |
| 1,574,710 | 2/1926 | Spreen | 220/215 |
| 1,811,286 | 6/1931 | Tyndall | 215/13 R X |
| 2,414,061 | 1/1947 | Richard et al. | 220/215 X |
| 2,428,056 | 9/1947 | Wachsman | 220/904 |
| 2,692,703 | 10/1954 | Brammins | 215/13 R |
| 2,748,946 | 6/1956 | Smith | 220/90.4 X |
| 2,753,990 | 7/1956 | Chalfin . | |
| 2,765,949 | 10/1956 | Hillman | 220/338 |
| 2,948,430 | 8/1960 | Teague, Jr. et al. | 220/338 X |
| 3,032,224 | 5/1962 | Lou | 215/13 R |
| 3,245,565 | 4/1966 | Zeppenfeld . | |
| 3,381,875 | 5/1968 | Tunick | 220/22 X |
| 3,400,855 | 9/1968 | Alexander | 220/90.4 |
| 3,705,661 | 12/1972 | Davis . | |
| 3,827,925 | 8/1974 | Douglas | 215/13 R X |
| 3,828,967 | 8/1974 | Grabhorn | 206/545 X |
| 3,869,771 | 3/1975 | Bollinger . | |
| 3,870,190 | 3/1975 | Tibbals, Jr. | 220/338 |
| 3,967,748 | 7/1976 | Albert | 220/90.4 |

FOREIGN PATENT DOCUMENTS

| | | | |
|---|---|---|---|
| 502009 | 3/1939 | United Kingdom | 220/90.4 |
| 770275 | 3/1957 | United Kingdom | 215/13 A |
| 1281534 | 7/1972 | United Kingdom | 215/13 R |

*Primary Examiner*—Allan N. Shoap
*Attorney, Agent, or Firm*—Vogel, Dithmar, Stotland, Stratman & Levy

[57] ABSTRACT

An insulated container with a double wall construction having a removable partition centrally located within the container dividing the container into two compartments. A top is pivotally mounted on the partition and is constructed to close one of the compartments at a time. Liquid in one compartment flows to the other compartment through a connection provided at the bottom of the partition. The container, the partition and the top are all thermally insulated.

23 Claims, 8 Drawing Figures

INSULATED CONTAINER

This application is a continuation of Ser. No. 905,639, May 15, 1978 abandoned.

BACKGROUND OF THE DISCLOSURE AND PRIOR ART STATEMENT

There are many insulated containers available today, such as thermos containers and the like. Recently, many insulated drinking mugs have appeared on the market and many varieties, even double walled containers are available. For instance, one such drinking mug advertised on television is a double walled mug having a top in order to keep the beverage inside warm for prolonged periods of time. Mugs of this type however, are cumbersome to use, since they require that the user continually manipulate the top in order to drink from the mug.

A prior art search has discovered the following United States patents. The Hilliary U.S. Pat. No. 584,937 shows an open medicine cup having a plurality of compartments therein. The Shafer, et al. U.S. Pat. No. 1,034,313 shows a container having two compartments therein separated by a partition. The Smith U.S. Pat. No. 2,748,946 shows a container with a centrally disposed strainer comprised of an apertured plate and a hinged top situated outside the container. The Chalfin, et al. U.S. Pat. No. 2,753,990 shows a two compartment container with a removable plug connecting the compartments. The Zeppenfeld, et al. U.S. Pat. No. 3,248,565 shows a two compartment container wherein the compartments are entirely separate. The Alexander U.S. Pat. No. 3,400,855 shows a container with a central partition to prevent spilling of the material contained therein. The Davis U.S. Pat. No. 3,705,661 shows a thermos type container with two separate compartments and the Bollinger U.S. Pat. No. 3,869,771 shows an anesthesia circuit wherein FIG. 2 shows a two compartment container.

SUMMARY OF THE INVENTION

This invention relates to an insulated container and more particularly to a thermally insulated coffee mug in which thermally insulated compartments are connected to provide communication therebetween and to permit heating of liquid in an open compartment by liquid in a closed compartment.

A principle object of the present invention is to provide an insulated multi-compartment container in which communication among the various compartments is provided to enable thermal convection between the compartments to occur.

An important object of the present invention is to provide a multiple compartment thermally insulated beverage container comprising longitudinally extending partition means inside the container defining multiple compartments separate one from the other along substantially the entire portion of the partition means with communication among the multiple compartments near the bottom thereof, and top means enclosing at least some compartments providing thermal insulation thereto, wherein at least some compartments are substantially enclosed.

Another object of the present invention is to provide a thermally insulated beverage container of the type set forth in which there is included longitudinally extending thermally insulating partition means constructed to fit entirely within the container and to extend a substantial longitudinal portion thereof and therein defining multiple compartments and providing communication among the compartments near the bottom thereof, and top means connected to the partition means constructed to fit entirely within the container enclosing at least some of the compartments providing thermal insulation thereto.

A further object of the present invention is to provide a multiple compartment thermally insulated container comprising an outer casing and an inner casing spaced therefrom defining a thermal insulating space therebetween, longitudinally extending partition means detachably fitting inside the inner casing and therein defining multiple compartments thermally insulated one from the other along substantially the entire portion of the partition means with communication among the multiple compartments near the bottom thereof, and top means enclosing at least some compartments providing thermal insulation thereto.

A still further object of the present invention is to provide a two compartment thermally insulated beverage container comprising an outer casing and an inner casing spaced therefrom defining a thermal insulating space therebetween, guide means at the inner surface of the inner casing, longitudinally extending partition means detachably engageable with the guide means, the partition means constructed to extend a substantial longitudinal portion of the inner casing therein defining first and second separate compartments and providing communication therebetween near the bottom thereof, and top means for enclosing at least one compartment providing substantial thermal insulation thereto.

Another object of the present invention is to provide a two compartment thermally insulated beverage container comprising an outer casing and an inner casing spaced therefrom defining a thermal insulating space therebetween, guide means diametrically positioned at the inner surface of the inner casing, longitudinally extending thermally insulating partition means detachably engageable with the guide means, the partition means constructed to fit entirely within the inner casing and to extend a substantial longitudinal portion thereof and therein defining first and second separate compartments and providing communication therebetween near the bottom thereof, and top means connected to the partition means constructed to fit entirely within the inner casing enclosing one of the compartments providing substantial thermal insulation thereto.

A final object of the present invention is to provide a two compartment thermally insulated beverage container comprising an outer cylindrical casing having a closed bottom and a circular edge defining an open top, an inner cylindrical casing having a closed bottom and an upwardly and outwardly extending lip with an exterior downwardly extending flange defining a circular edge connected to the circular edge of the outer casing and defining a closed air space between the inner and outer casings, a handle extending outwardly from the outer casing a first and second pair of longitudinally extending spaced apart guides on the inner surfaces of the inner casing extending between the bottom of the inner casing and terminating below the lip, the first and second pair of guides being diametrically positioned and aligned with the handle, a ledge on the interior surface of the inner casing extending therearound and extending upwardly along the interior surface from the juncture thereof with the first and second pair of guides with the uppermost portions of the ledge being diametrically positioned 90° from the guides, a partition having spaced apart flat walls defining a closed air space therebetween constructed to slide between the first and second pair of guides and to be frictionally engaged thereby, the partition having a bottom terminating above the bottom of the inner casing and having a plurality of legs extending downwardly therefrom for engagement with the inner casing bottom and defining passageways interconnecting the two compartments formed on opposite sides of the partition, and a hemi-elliptical or semi-elliptical double walled top having a resilient gasket therearound journaled for rotation in the partition wherein the arcuate portion of the top rests on the ledge and the gasket forms an air tight seal between the top and the inner casing above the ledge, the top slanting downwardly from the uppermost portion of the ledge toward the partition.

These and other objects of the present invention will be more readily understood by reference to the following specification, taken in conjunction with the accompanying drawings, in which:

DESCRIPTION OF THE PREFERRED EMBODIMENT

Figure 1:
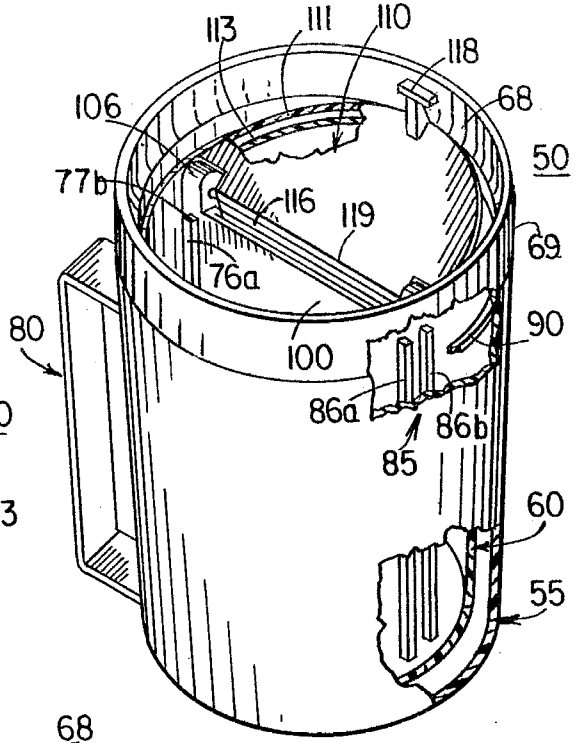
FIG. 1 is an enlarged perspective view partially broken away of an insulated drinking container embodying the principles of the present invention wherein the partition is arranged for left-hand use of the container.

Referring now to the drawings, there is disclosed a container 50 comprising an outer cylindrical casing 55 having side walls 56 connected by a bottom wall 57 with the exposed circular top edge 58 being stepped or notched. An inner cylindrical casing 60 has a side wall 61 and a closed bottom wall 62. The side wall 61 has an upper section 65 which has an outwardly extending discontinuity therein from the side wall 61 to a longitudinal side wall 67 having a larger diameter than the side wall 61 and forming a ledge 90 for a purpose hereinafter set forth. A concave lip section 68 extends upwardly and outwardly from the juncture of the lip section 68 with the wall 67 and an outer flange 69 extends downwardly to a stepped exposed edge 71 which is of the same diameter and is a mirror image of the edge 58. As seen, the edges 58 and 71 are joined together to provide a trapped air space 74 between the inner casing 60 and the outer casing 55.

Both the inner casing 60 and the outer casing 55, the side walls respectively 61 and 56, are provided with a draft for molding purposes, whereby the bottoms 62 and 57 having a smaller circumference than the tops of the respective casings 60 and 55. Joining the edges 58 and 71 can be accomplished in one of several art recognized fashions, for instance, friction welding, adhesives or ultrasonic welding are all available. The container 50 and particularly the outer and inner casings 55 and 60, respectively, may be made from several art recognized synthetic organic resins, such as polycarbonates, polystyrenes and ABS, with ABS being the preferred material.

Within the inner casing 60 are two diametrically positioned guides 75 and 85. Each of the guides 75 and 85 are comprised of spaced apart longitudinally extending rails respectively 76A and 76B and 86A and 86B. With respect to the guide 75, the rails 76A and 76B each have a top 77A and 77B, respectively, which terminates at a point below the ledge 90 in the inner wall 61. The rails 76A and 76B are parallel and extend longitudinally downwardly to the bottom of the inner casing 60 wherein the bottom ends 78A and 78B, respectively of the rails 76A and 76B, are in contact with the bottom 62 of the inner casing 60. Similarly, the guide 85 is comprised of spaced apart longitudinally extending rails 86A and 86B, each of which respectively has a top end 87A and 87B and a bottom end 88A and 88B. The rails 86A and 86B are parallel and extend longitudinally in the same manner as the rails 76A and 76B. The guides 75 and 85 are in registry one with the other and are diametrically positioned within the inner casing 60.

A handle 80 is fixedly connected to the outer casing 55 and is in registry with the two guides 75 and 85, the handle 80 having upper and lower reaches, respectively 81 and 82, interconnected by a bight 83. As will be made more clearly apparent hereinafter, the location of the handle 80 in registry with or alternatively lying in a plane or area defined by the guides 75 and 85 is critical.

The ledge or top rest 90 is formed on the inner surface of the inner casing 60 with the top rest or ledge 90 being formed by the discontinuity in diameter between wall sections 61 and 67. The rest 90 is an arcuate ledge 91 extending completely around the inner surface of the inner casing 60. The ledge 91 is somewhat elliptical in shape with the lowest portions 92 being adjacent to the rails 76B and 86B on the one side of the inner casing 60, and adjacent to the rails 76B and 86B on the other side of the inner casing. The ledge 91 has upper areas 93 at points approximately 90° from the handle 80 or the area defined between the guides 75 and 85.

It is seen then that top rest 90 is a continuous ledge 91, elliptical in plan view, and having upper areas 93 approximately 90° from the handle 80 and lower areas 92 adjacent the guides 75 and 85 in the plane of the handle 80.

A partition 100 is comprised of spaced apart parallel longitudinally extending walls 101 and 102 enclosed by a bottom 103 and end walls 107 defining an air space 104 therebetween. A plurality of extensions or feet 105 extend outwardly from the bottom 103 of the partition 100 forming a strainer for a purpose hereinafter set forth. At the top of the partition 100 at the side walls 107 thereof, are spaced apart journals 106, also for a purpose hereinafter set forth. The thickness of the partition 100 is predetermined such that the partition fits within each of the rails 76A, B and 86A, B, thereby to permit sliding engagement of the partition with the guides 75 and 85.

The width of the partition 100 is such that the partition 100 fits snugly against the wall of the inner casing 60, but yet is able to slide with respect thereto, a draft being provided to the partition 100 to accommodate for the draft on the inner casing 60; that is, the partition 100 is wider at the top, where the journals 106 are located, than at the bottom 103. Both the feet 105 and the journals 106 limit the vertical movement of the partition 100 in the casing 60.

The thickness of the partition 100 is determined by the desired thermal insulating characteristics which in part are determined by the material of the partition, which may be polycarbonate, polystyrene or ABS, and also determined by whether the air space 104 is filled with an expanded or foamed polyurethane or polystyrene type material 108 or whether the space 104 is merely an insulating air space. Nevertheless, the thickness of the partition 100 is predetermined and uniform to permit easy sliding of the partition within the appropriate guides 75 and 85.

Journaled for rotation in the partition and particularly the journals 106 thereof is a top 110. The top 110 comprises spaced apart top and bottom walls, respectively 111 and 113 defining an air space 114 therebetween which may be provided with an insulating foam material 121. The top 110 has spaced apart journal pins 112 sized to fit within the journals 106 of the partition and to provide rotation between the top and the partition. Connecting the top wall 111 and the bottom wall 113 is an end wall 115 having an arcuate edge 117 and a straight edge 119. A gasket 116 of resilient material is positioned around at least the arcuate edge 117 and preferably around both the arcuate edge 117 and the straight edge 119. Finally, a handle 118 extends upwardly from the top wall 107 of the top 110 to provide easy handling.

Figure 4:
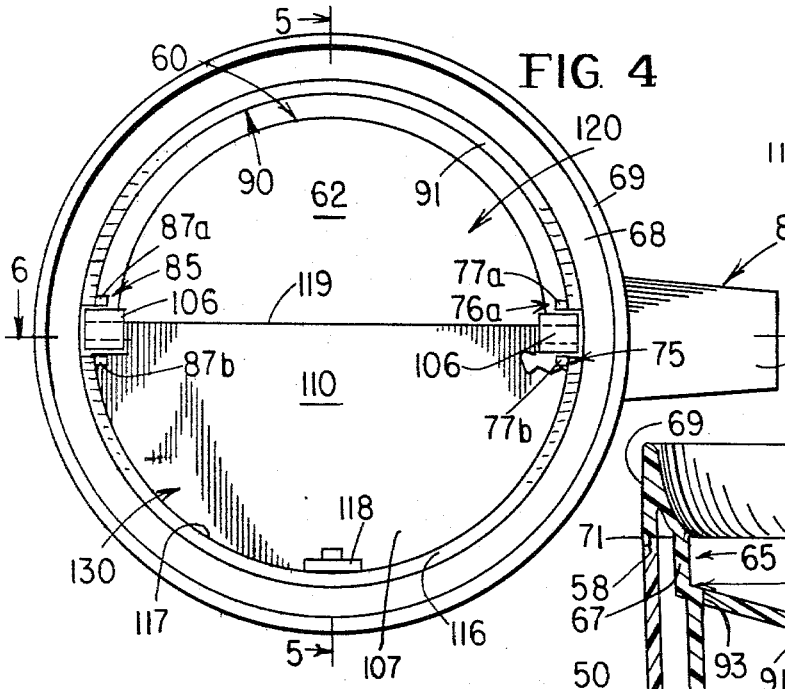
FIG. 4 is a top plan view of the container illustrated in FIG. 1.
Figure 8:
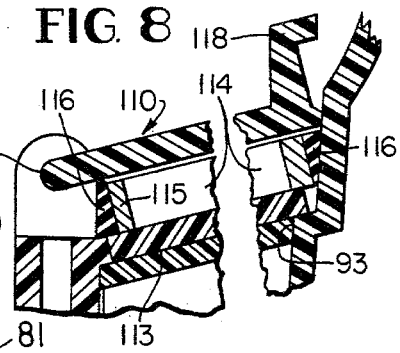
FIG. 8 is an enlarged fragmentary view of the top and gasket member therefor illustrated in FIG. 5.
Figure 5:
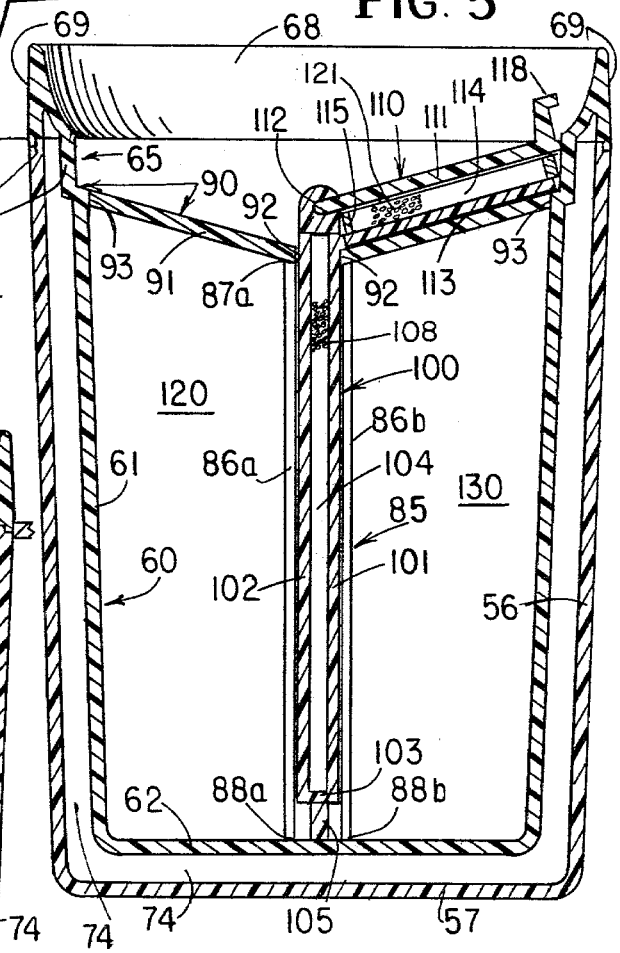
FIG. 5 is a view in section of the insulated container illustrated in FIG. 4, as viewed along the line 5—5 thereof.
Figure 6:
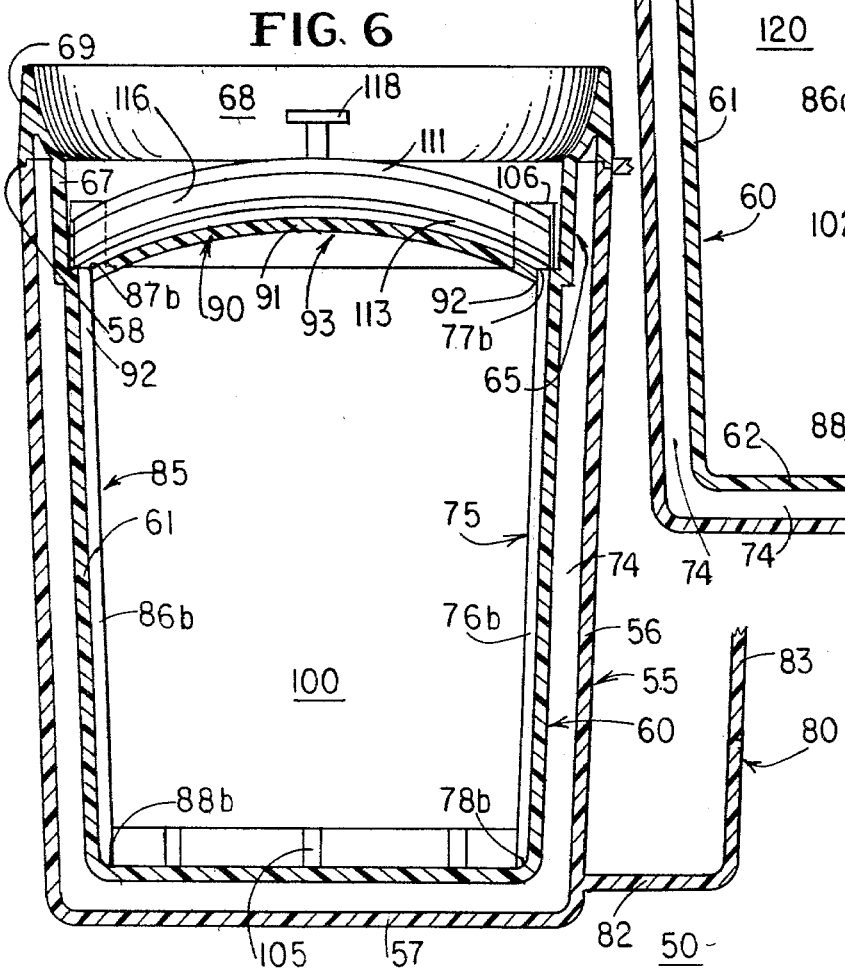
FIG. 6 is a view in section of the container illustrated in FIG. 4 as viewed along line 6—6 thereof.

As seen from the drawings, and particularly FIGS. 4 and 5, the insulated container 50 with the partition 100 in place is divided into two compartments 120 and 130 with the compartment 130 being substantially entirely insulated whereas the compartment 120 is only partially insulated. Communication between compartments 120 and 130 is provided only at the bottom of the partition 100 through the area between the bottom 103 of the partition and the bottom 62 of the inner casing 60, interrupted only by the feet 105. The thermal insulation provided to compartment 130 is extremely effective, because the compartment is almost entirely closed. The inner casing 60 and the outer casing 55 provide a double walled construction, wherein the air space 74 therebetween may be either empty, thereby providing good insulating properties or be filled with an expanded polyurethane or polystyrene foam, thereby providing superior thermal insulating properties. Similarly, the partition 100 is of double walled construction and defines an air space 104 therebetween which either may be empty thereby providing good thermal insulating properties or be filled with the aforementioned polyurethane or polystyrene expanded foam, thereby providing superior thermal insulating properties.

Similarly, the top 110 is of double walled construction with an air space 114 which may be either empty or filled as hereinbefore set forth. The top 110 is snugly fitted against the longitudinal wall portion 67 of the inner casing 60 and also the top edge of the partition 100. The resilient gasket 116 provides a secure seal between the top 110, the wall 67 and the partition 100. The location of the journals 106 above the edge 119 of the top 110 ensures a tight seal between the top and the partition 100. Further, the top 110 and particularly the bottom wall 113 thereof fits snugly against the ledge 91 of the top rest 90, thereby ensuring adequate support and critical positioning of the top 110. The ledge 91 also assists in providing an air-tight seal to the compartment 130.

As noted in the drawings, the top 110 when in position to form the enclosed compartment 130, slants downwardly from the exterior of the cup toward the interior thereof or the partition 100. This positioning is critical to operation of the insulated container 50 as will be hereinafter explained.

The container 50 operates on the principle that heated liquid in the compartment 130 is used as a heater or radiator for heated liquid in the compartment 120, it being recognized that a temperature gradient will exist between the liquids in compartments 120 and 130 due to the difference in thermal insulation of the two compartments. Since the compartment 130 is almost entirely thermally insulated, whereas the compartment 120 is open to the atmosphere at the top thereof, the liquid in the compartment 120 will cool at a faster rate than the liquid in the compartment 130. However, the communication provided between the compartments 120 and 130 near the bottom 62 of the inner casing 60 allows thermal conduction and mixing to occur between the liquids in the two compartments. This is a fundamental feature of the present invention and one which provides a great advantage over other insulated containers presently available.

Unlike the previously mentioned insulated coffee mugs with tops provided, the container 50 of the present invention can be utilized by any person without continuously manipulating the top 110. The container 50 of the present invention will maintain liquid therein significantly hotter for a longer period of time than liquid in an entirely open cup, particularly when the container is tilted for drinking which mixes liquid from compartment 130 with liquid in compartment 120. The container 50 will not keep liquid quite as hot as a container with a top which remains in place for an extended period of time. Nevertheless, the small sacrifice in heating insulation is more than made up for by the convenience of the present invention, and by the fact that when liquid in compartment 120 is drunk, the liquid from compartment 130 which replaces the lost liquid from compartment 120 heats the liquid in compartment 120 resulting, in some cases, in net increase in temperature for the liquid in compartment 120. Specifically, the container 50 illustrated in FIG. 1 shows the top 110 and partition 100 mounted in position for left-handed use, wherein the user holds the cup with the left hand and the open compartment 120 is then forward facing for drinking.

Figure 2:
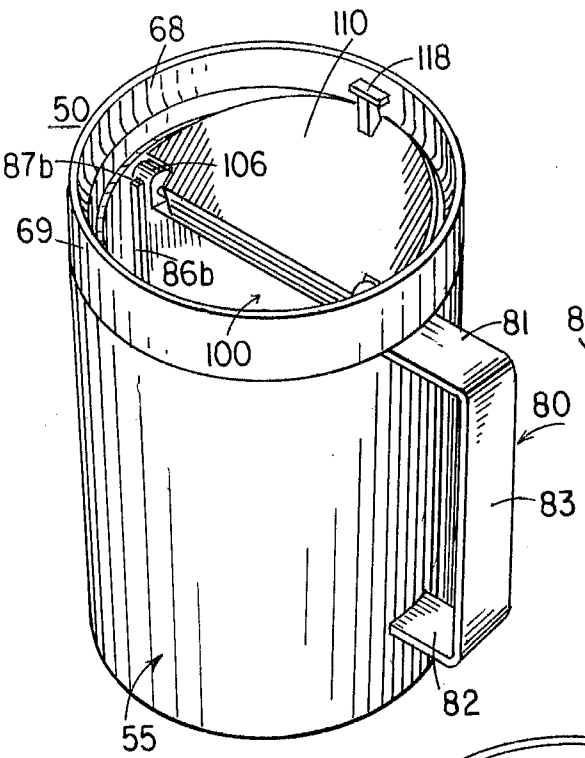
FIG. 2 is a perspective view of an insulated container of the type illustrated in FIG. 1, wherein the partition and top are positioned for right-hand use.
Figure 7:
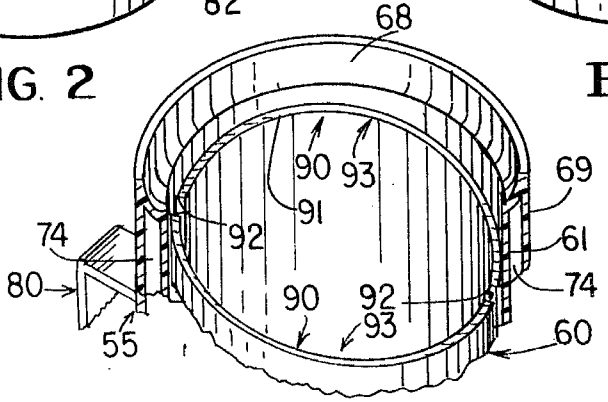
FIG. 7 is a perspective view of a top portion of the insulated container particularly showing the top supporting ledges thereof.
Figure 3:
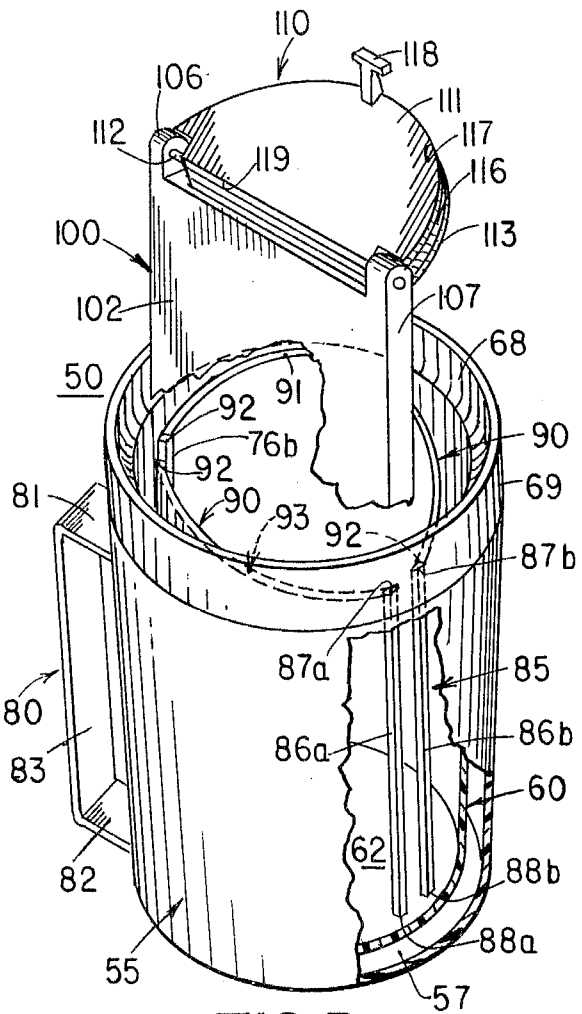
FIG. 3 is an exploded perspective view partially broken away of the container illustrated in FIG. 1, showing the spaced relationship between the partition, top and double wall container.

FIG. 2 shows the partition 100 and top 110 in position for right-handed use, wherein the top is positioned such that the open compartment 120 is reversed with respect to that shown in FIG. 1, so that a user holding the container with the right hand has the open compartment 120 foremost facing. Since the partition 100 is removable from the guides 75 and 85, it is a simple matter to reverse the partition to obtain the construction shown in FIG. 1 or FIG. 2, depending on the user's preference.

The positioning of the top 110 as previously discussed is critical to the performance of the cup to the container 50 in that the downwardly and inwardly slanting position facilitates using the container without contact between the user's face and the cup rim 68 and also enables beverage to be poured into the open compartment 120 and if beverage spills onto the top wall 111 of the top 110, the beverage will run naturally into the open compartment 120. For these reasons, it is preferred that the top 110 be slanted downwardly and inwardly toward the open compartment 120 at an angle of approximately 15°, as illustrated.

The relationship between the top rest 90 with the raised portions 93 thereof, and the handle 80 or guides 75 and 85 is now apparent. With the guides 75 and 85 in registry with the handle 80, the top rest 90 is positioned to place the top 110 in either the positions illustrated in FIGS. 1 or 2, wherein the top slants downwardly and inwardly toward the compartment 120. As stated, the top 110 position is more than mere design, but contributes significantly to the usefulness of the container 50.

The communication between the compartments 120 and 130 permits cream and sugar to be added to compartment 120 and to mix into the liquid in compartment 130 without raising the top 110. This is advantageous, since the compartment 130 remains almost totally insulated, thereby maintaining the liquid therein hot. Further, the container 50 is more convenient to use if stirring in only one compartment is necessary to effect adequate mixing of additives, such as cream or sugar.

A further feature of the present invention is its use to keep liquid colder than possible with a completely open container, the provision of the feet 105 preventing ice from leaving the compartment 130 when liquid is drunk from the compartment 120. Even in a rather warm environment, the colder liquid in compartment 130 mixes with and reduces the temperature of the liquid in compartment 120 when liquid is dispensed from the container 120. This is analogous to the heating phenomenon previously discussed.

Finally, although not shown, a small aperture exists in the top 110 to permit air to escape when the container 50 is filled with liquid, since preferably the top 110 is sealed except when the container is washed or cleaned. At that time, the top 110 along with the partition 100 are removed for easy and complete cleaning. Upon replacement of the partition 100 in the inner casing 60, either right-hand use or left-hand use can be selected.

Lesser efficient containers utilizing the fundamental novel concepts of the present invention may be constructed out of single walled thermally insulating material and may even provide a fixed partition and top. The construction illustrated in the foregoing application is preferred, because the container 50 is easily cleaned by completely removing the partition 100 and connected top 110, thereby permitting the container 50 to be cleaned for repeated use. Further, both right-handed and left-handed users are accommodated with the design and construction of the present invention, whereas a cheaper model may be constructed which would not have these features. The present invention is such that a partition 100 is provided in a container 50 which divides the container into multiple compartments 120 and 130, wherein the compartments 120 and 130 are thermally insulated one from the other along substantially the entire longitudinal extent of the partition with communication being provided among all of the compartments near the bottom 62 of the container to permit thermal mixing and heating of the liquid in the open compartment by the liquid in the entirely closed compartment. This fundamental concept is the crux of the invention.

While there has been described what at present is considered to be the preferred embodiment of the present invention, it will be understood that various modifications and alterations may be made therein without departing from the true spirit and scope of the present invention, and it is intended to cover in the appended claims all such modifications and alterations.

What is claimed is:

1. A multiple compartment thermally insulated beverage container having opposed wall surfaces with insulating means therebetween, said container including longitudinally extending partition means inside said container defining multiple compartments separate one from the other along substantially the entire portion thereof, said partition means comprising two opposing imperforate wall surfaces with insulating means therebetween, said imperforate wall surfaces being spaced from and interconnected to each other about the periphery thereof, stop means for causing the bottom periphery of said imperforate wall surfaces to be spaced above the bottom of the container thereby providing communication between compartments and top means enclosing at least one of said compartments while allowing another compartment to remain substantially opened at the top thereof, said top means comprising a closure pivotally connected to the upper part of said partition means between the opposing imperforate wall surfaces.

2. The multiple compartment thermally insulated beverage container set forth in claim 1, wherein said container and said partition means are a synthetic organic resin selected from a class consisting of a polycarbonate, ABS, polystyrene and a polypropylene.

3. The multiple compartment thermally insulated beverage container set forth in claim 1, wherein said top means has a resilient gasket at the edge thereof to provide a seal between said top means and the adjacent container wall surface.

4. The multiple compartment thermally insulated beverage container set forth in claim 1, wherein said container is a two compartment container, said top means in the closed position thereof defining a substantially flat inclined plane slanting toward an uncovered compartment.

5. The two compartment thermally insulated beverage container set forth in claim 4, wherein said partition means includes a space defining said insulating means.

6. The two compartment thermally insulated beverage container set forth in claim 5, and further comprising a foamed synthetic organic resin selected from the class consisting of polyurethane and polystyrene in said space.

7. The two compartment thermally insulated beverage container set forth in claim 4, wherein said top means has spaced apart walls defining a space therebetween.

8. The two compartment thermally insulated beverage container set forth in claim 7, and further comprising a foamed synthetic organic resin selected from the class consisting of a polyurethane and a polystyrene in said space between said walls of said top means.

9. The multiple compartment thermally insulated beverage container set forth in claim 1, wherein said container has inner and outer spaced walls and said partition means is slidable with respect to the inner wall.

10. The multiple compartment thermally insulated beverage container set forth in claim 9, wherein said stop means includes spaced apart extensions depending from the bottom of said partition means in contact with the bottom of said container.

11. The multiple compartment thermally insulated beverage container set forth in claim 9, wherein said partition means has spaced apart walls defining a space therebetween.

12. The multiple compartment thermally insulated beverage container set forth in claim 9, wherein said top means has spaced apart walls and has a resilient gasket at the periphery thereof.

13. The multiple compartment thermally insulated beverage container set forth in claim 9, and further comprising a handle on the outside of said container and diametrically positioned rest means on the inner wall extending inwardly thereof positioned 90° from said handle.

14. The multiple compartment thermally insulated beverage container set forth in claim 1, wherein said container is a two compartment container, said container further comprising inner and outer spaced walls defining a thermal insulating space therebetween, guide means at the inner surface of said container said partition means being detachably engageable with said guide means.

15. The two compartment thermally insulated beverage container set forth in claim 14, wherein said guide means are two pair of spaced apart rails and said partition means fits within each pair and is slidable with respect thereto.

16. The two compartment thermally insulated beverage container set forth in claim 14, and further comprising a handle in registry with said guide means integral with the outer wall and extending outwardly therefrom.

17. The two compartment thermally insulated beverage container set forth in claim 16, and further comprising rest means on the inner surface of the inner wall for supporting said top means in the closed position thereof.

18. The two compartment thermally insulated beverage container set forth in claim 17, wherein said rest means comprises a ledge extending circumferentially around said inner wall.

19. The two compartment thermally insulated beverage container set forth in claim 17, wherein said rest means is a ledge extending inwardly from the inner surface of said inner wall and curves upwardly away from said guides.

20. The two compartment thermally insulated beverage container set forth in claim 14, wherein said top means is pivotally mounted above said partition means on journals extending therefrom.

21. The two compartment thermally insulated beverage container set forth in claim 20, wherein said top means is constructed to fit snugly within the inner wall and has resilient material on the outer peripheral edge thereof.

22. The two compartment thermally insulated beverage container set forth in claim 14, wherein said top means is semi-elliptical in plan view.

23. A two compartment thermally insulated beverage container comprising an outer cylindrical casing having a closed bottom and a circular edge defining an open top, an inner cylindrical casing having a closed bottom and an upwardly and outwardly extending lip with an exterior downwardly extending flange defining a circular edge connected to said circular edge of said outer casing and defining a closed space between said inner and outer casings, a handle extending outwardly from said outer casing, a first and second pair of longitudinally extending spaced apart guides on the inner surface of said inner casing extending between the bottom of said inner casing and terminating below said lip, said first and second pair of guides being diametrically positioned and aligned with said handle, a ledge on the interior surface of said inner casing extending therearound and extending upwardly along said interior surface from the juncture thereof with said first and second pair of guides with the uppermost portions of said ledge being diametrically positioned 90° from said guides, a partition having spaced apart flat walls defining a closed space therebetween constructed to slide between said first and second pair of guides and to be frictionally engaged thereby, said partition having a bottom terminating above the bottom of said inner casing and having a plurality of legs extending downwardly therefrom for engagement with said inner casing bottom and defining passageways interconnecting the two compartments formed on opposite sides of said partition, and a semi-elliptical double walled top having a resilient gasket therearound journaled for rotation in said partition wherein the arcuate portion of said top rests on said ledge and said gasket forms an air tight seal between said top and said inner casing above said ledge, said top slanting downwardly from the uppermost portion of said ledge toward said partition.

* * * * *